US009200433B2

(12) United States Patent
Tasovski

(10) Patent No.: US 9,200,433 B2
(45) Date of Patent: Dec. 1, 2015

(54) TOOL RETENTION SYSTEM

(71) Applicant: Caterpillar Inc., Peoria, IL (US)

(72) Inventor: Vasil S. Tasovski, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 134 days.

(21) Appl. No.: 14/045,150

(22) Filed: Oct. 3, 2013

(65) Prior Publication Data

US 2015/0096207 A1 Apr. 9, 2015

(51) Int. Cl.
*E02F 9/28* (2006.01)

(52) U.S. Cl.
CPC ..... *E02F 9/2841* (2013.01); *E02F 9/2825* (2013.01); *E02F 9/2833* (2013.01)

(58) Field of Classification Search
CPC ..... E02F 9/2833; E02F 9/2825; E02F 9/2841; B25B 13/48; B25B 21/002; B25B 21/004; B64D 45/02; F16L 55/179; F16L 55/132; F16L 55/265; F16B 37/14
USPC ..... 37/446, 451–456; 403/374.3, 374.1, 403/373; 411/373, 377, 431
See application file for complete search history.

(56) References Cited

U.S. PATENT DOCUMENTS

| | | | | |
|---|---|---|---|---|
| 4,433,496 | A | 2/1984 | Jones et al. | |
| 4,576,533 | A * | 3/1986 | Chartier | 411/373 |
| 5,035,265 | A * | 7/1991 | Chen | 138/89 |
| 5,410,826 | A | 5/1995 | Immel et al. | |
| 5,452,529 | A | 9/1995 | Neuenfeldt et al. | |
| 5,784,813 | A | 7/1998 | Balassa et al. | |
| 5,868,518 | A | 2/1999 | Chesterfield et al. | |
| 5,964,547 | A | 10/1999 | Brinkley | |
| 6,009,644 | A | 1/2000 | Hedley | |
| 6,301,810 | B1 | 10/2001 | Fidler | |
| 6,986,216 | B2 | 1/2006 | Emrich et al. | |
| 7,516,564 | B2 | 4/2009 | Ruvang | |
| 7,640,684 | B2 | 1/2010 | Adamic et al. | |
| 8,388,293 | B2 * | 3/2013 | Hutter, III | 411/377 |
| 8,458,931 | B2 | 6/2013 | Knight | |
| 2011/0072693 | A1 | 3/2011 | Knight | |
| 2011/0232793 | A1 * | 9/2011 | Polivka et al. | 138/98 |

OTHER PUBLICATIONS

U.S. Appl. No. 13/862,1114 of Marcus John Guethle et al. entitled "Steering Linkage Arrangement for Articulated Mobile Machine" filed on Apr. 12, 2013.
U.S. Appl. No. 13/914,297 of Garrett D. Knight entitled "Excavator Tooth Retention Device" filed on Jun. 10, 2013.
(Continued)

*Primary Examiner* — Robert Pezzuto
(74) *Attorney, Agent, or Firm* — Finnegan, Henderson, Farabow, Garrett & Dunner, LLP

(57) ABSTRACT

A retention system is provided for use with a ground engaging tool. The tool retention system may have a generally C-shaped clamp configured to be disposed within an aperture of a work implement and to engage apertures in a tool adapter and a wedge disposed within the apertures of the tool adapter and the work implement and against the generally C-shaped clamp. The retention system may additionally have a generally C-shaped slider disposed within the apertures of the tool adapter to engage the aperture of the work implement and a fastener configured to connect the generally C-shaped slider to the wedge. A retention cap with an expandable retention washer may be secured over a head of the fastener to prevent unwanted rotation.

18 Claims, 5 Drawing Sheets

(56) References Cited

OTHER PUBLICATIONS

U.S. Appl. No. 13/920,539 of Patrick Simon Campomanes entitled "Tooth Retention System" filed on Jun. 18, 2013.

http://xml.catmms.com/servlet/imageservlet?imageID=c609127 &imagetype=2, 99. 1-24 (2010).

http://xml.catmms.com/servlet/ImageServlet?imageID=C743073 &imageType=2, pp. 1-20 (2012).

* cited by examiner

TOOL RETENTION SYSTEM

TECHNICAL FIELD

The present disclosure relates generally to a retention system and, more particularly, to a system for retaining a ground engaging tool connected to a work implement.

BACKGROUND

Earth-working machines, such as excavators, wheel loaders, electric cable shovels, and front shovels, include implements generally used for digging into, ripping, or otherwise moving earthen material. These implements are subjected to extreme abrasion and impacts that causes them to wear. To prolong the useful life of the implements, various ground engaging tools can be connected to the earth-working implements at areas experiencing the most wear. These ground engaging tools are releasably connected to the implements using a retention system.

An exemplary retention system is disclosed in U.S. Patent Publication 2011/0072693 of Knight that published on Mar. 31, 2011 ("the '693 publication"). Specifically, the '693 publication discloses a fork-shaped tool body that fits over the edge of an excavator bucket. A clamp passes through the body and the bucket, and a wedge is inserted alongside the clamp to hold the clamp in position. The wedge has a U-shaped axial recess, and a threaded rod is received within the recess and oriented at an angle relative to the clamp. A threaded block is mounted to the rod, and the rod is rotatable to move the block along the rod. The block includes teeth that engage the clamp upon insertion of the wedge into the body, such that as the rod is rotated and the block moves along the rod, the wedge is forced further into the body. As the wedge is forced further into the body, the clamp is urged tighter against the body and the bucket. A resilient cap makes a friction fit with an end of the rod after assembly, thereby inhibiting inadvertent rotation of the rod. With this configuration, the fork-shaped tool body can be removably connected to the excavator bucket by rotation of the rod.

Although acceptable for some applications, the retention system of the '693 publication may be less than optimal. In particular, the resilient cap may be dislodged during use, which can then allow unwanted rotation of the rod and loosening of the retention system.

The disclosed tool retention system is directed to overcoming one or more of the problems set forth above.

SUMMARY OF THE INVENTION

One aspect of the present disclosure is directed to a retention cap for use with a fastener having a head with a tool interface, the retention cap including a body with a top surface and a bottom surface; a protrusion extending outward from the body; and a retention plug extending from the bottom surface of the body. The retention plug includes a threaded fastener, a rubber insert received around the threaded fastener, and a nut positioned on the threaded fastener. The retention plug is configured to cause expansion of the rubber insert within the tool interface upon rotation of one of the nut or threaded fastener.

Another aspect of the present disclosure is directed to a retention cap for a fastener including a generally circular body having a top surface, a bottom surface and an outer peripheral surface and a bore defined by the body and extending between the top surface and the bottom surface. A protrusion extends radially outward from the body; and a retention plug extends from the bottom surface. The retention plug includes a threaded fastener with a head positioned adjacent the top surface of the body, a rubber insert received around the threaded fastener and positioned adjacent the bottom surface of the body, and a nut positioned on the threaded fastener. Rotation of the nut or threaded fastener is configured to compress and cause lateral expansion of the rubber insert within a tool interface of a fastener.

Another aspect of the present disclosure is directed to a tool retention system including a generally C-shaped clamp configured to be disposed within an aperture of a work implement and to engage apertures in a tool adapter; a wedge configured to be disposed within the apertures of the tool adapter and the work implement and against the generally C-shaped clamp; and a generally C-shaped slider configured to be disposed within the apertures of the tool adapter and to engage the aperture of the work implement, and having an opening oriented away from the generally C-shaped clamp. The tool retention system also includes a fastener configured to connect the generally C-shaped slider to the wedge, the fastener having a head with a tool interface, and a retention cap positioned over the head of the fastener. The retention cap includes an expandable rubber insert that is positioned within the tool interface of the head.

DETAILED DESCRIPTION

Figure 1:
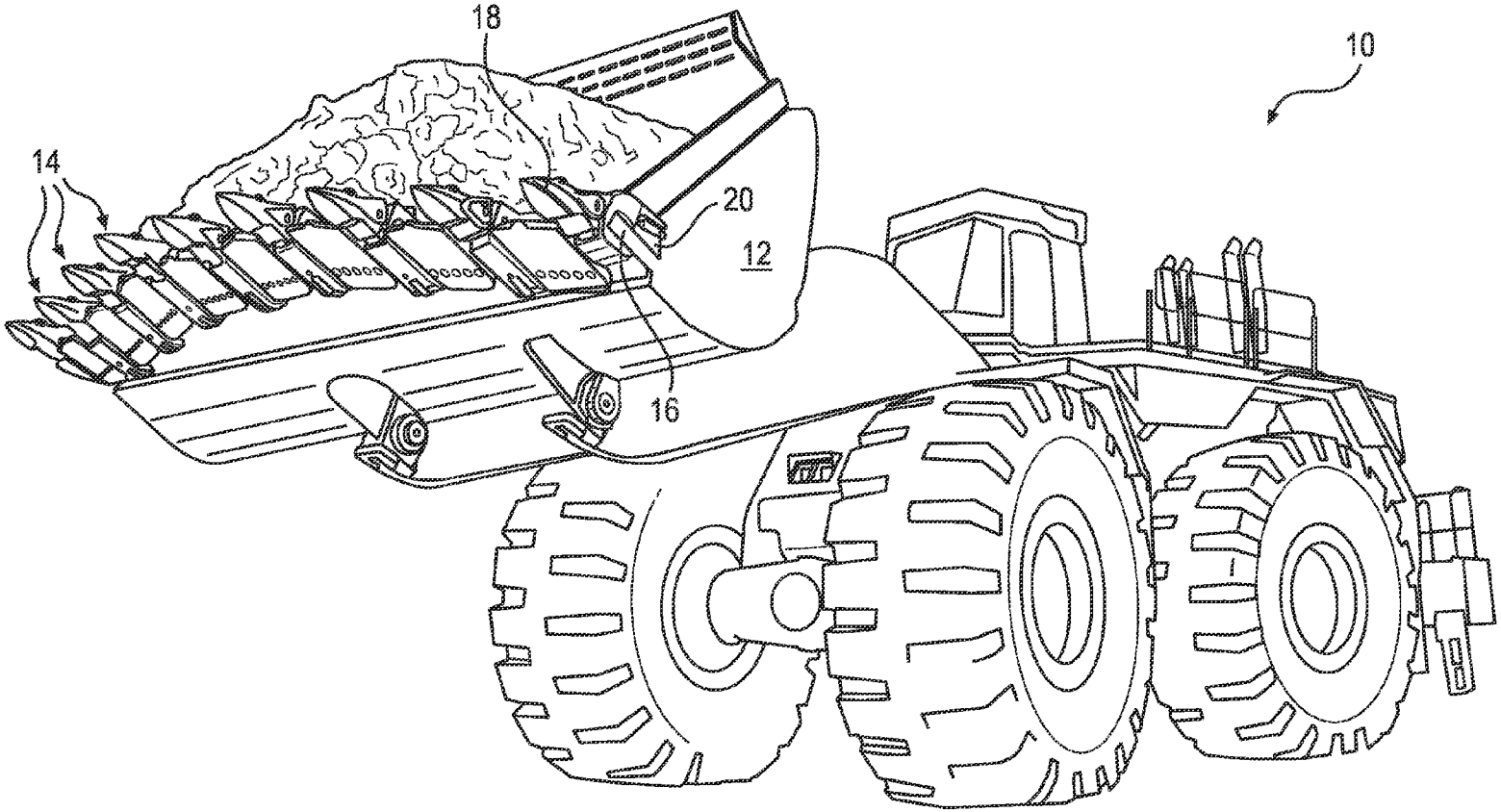
FIG. 1 is an isometric view of an exemplary machine.

FIG. 1 illustrates a mobile machine 10 having a work implement 12 operatively connected at a leading end. In the disclosed embodiment, machine 10 is a wheel loader. It is contemplated, however, that machine 10 may embody any other type of mobile or stationary machine known in the art, for example an electric cable shovel, an excavator, a motor grader, a dragline machine, a dredge, or another similar machine. Machine 10 may be configured to use work implement 12 to move material, such as earthen material, during completion of an assigned task. Although shown as being located at the leading end of machine 10, it is contemplated that work implement 12 could alternatively or additionally be located at a midpoint or trailing end of machine 10, if desired.

Work implement 12 may embody any device used to perform a particular task such as, for example, a bucket (shown in FIG. 1), a blade, a shovel, a crusher, a grapple, a ripper, or any other material moving device known in the art. In addition, although connected in the embodiment of FIG. 1 to lift, curl, and dump relative to machine 10, work implement 12 may alternatively or additionally rotate, swing, pivot, slide, extend, open/close, or move in another manner known in the art.

Work implement 12 may be equipped with one or more ground engaging tools (GET) 14 located at or adjacent to a cutting edge 16. For example, the disclosed bucket is shown as being provided with nine similar tooth assemblies that are spaced apart along the length of cutting edge 16. While shown as single-point, sharpened tooth assemblies, it is contemplated that GET 14 could take any other form known in the art, for example a fork (i.e., multi-point) configuration, a chisel (i.e., blade) configuration, or a blunt-end configuration.

GET 14 may be a conventional single-piece component or multi-piece component that is removably connected to work implement 12. In the embodiment shown in FIG. 2, GET 14 is a two-piece component having a tip 18 and an adapter 20 that are connected to cutting edge 16 of work implement 12 via a retention system 22. Tip 18 may be joined to a nose end 24 of adapter 20 in any manner known in the art, for example via welding, threaded fastening, integral posts and clips, etc. In certain embodiments a releasable retention system may be used to secure tip 18 to nose end 24 of adapter 20, thereby allowing for removal and replacement of tip 18 as required. Similarly, retention system 22 may be used to removably connect GET 14 to work implement 12.

Retention system 22 may include components that interact to clamp an associated GET 14 in a removable manner to cutting edge 16 of work implement 12. Specifically, retention system 22 may include a clamp 26, a wedge 28, a slider 30, a fastener 32, and a retention cap 34. As will be described in more detail below, clamp 26 may pass through adapter 20 and work implement 12, and wedge 28 may be used to hold clamp 26 in place. Slider 30 may engage work implement 12 and be connected to wedge 28 by fastener 32. Retention cap 34 may be used to inhibit unintentional removal or loosening of fastener 32.

Adapter 20 may include legs 38 that extend in a direction away from nose end 24. Legs 38 may be spaced apart from each other to form a recess 40 therebetween that is large enough to receive cutting edge 16 of work implement 12. An elongated aperture 42 may be formed within each leg 38, and apertures 42 may be generally aligned with each other and with a corresponding aperture 44 in work implement 12. A trailing end of legs 38 may taper inward toward apertures 42, such that a thickness of each leg 38 is less at aperture 42 than at a distal end 46 of leg 38. In some embodiments, a lifting eye 48 may be associated with adapter 20 to facilitate installation and removal thereof using a crane or other lifting device.

Clamp 26 may be generally C-shaped, having a middle section 50 and spaced-apart arms 52 located at opposing ends of middle section 50. Arms 52 extend in the same direction from the same side of middle section 50, and that side of the clamp 26 may be referred to as the open side. Clamp 26 may be inserted through apertures 42 of adapter 20 and aperture 44 of work implement 12, with the open side of clamp 26 oriented away from cutting edge 16. Interior surfaces 53 of arms 52 may be configured to engage the outer tapered surfaces at distal ends 46 of both legs 38, such that as clamp 26 is moved away from cutting edge 16, the taper will cause arms 52 to generate inward forces (i.e., toward recess 40) that sandwich work implement 12 between legs 38. Middle section 50 of clamp 26 may have an inner (relative to the C-shape) surface 54 that is generally planar and aligned with an axis 56 of apertures 42, 44, and a generally flat outer surface 58 that is inclined relative to axis 56. As clamp 26 is moved away from cutting edge 16, inner surface 54 may engage an inner end surface of apertures 42 and/or 44. Additionally, a release feature (e.g., a lifting eye) 62 may be included in some designs to facilitate installation and/or removal of clamp 26, if desired.

Figure 2:
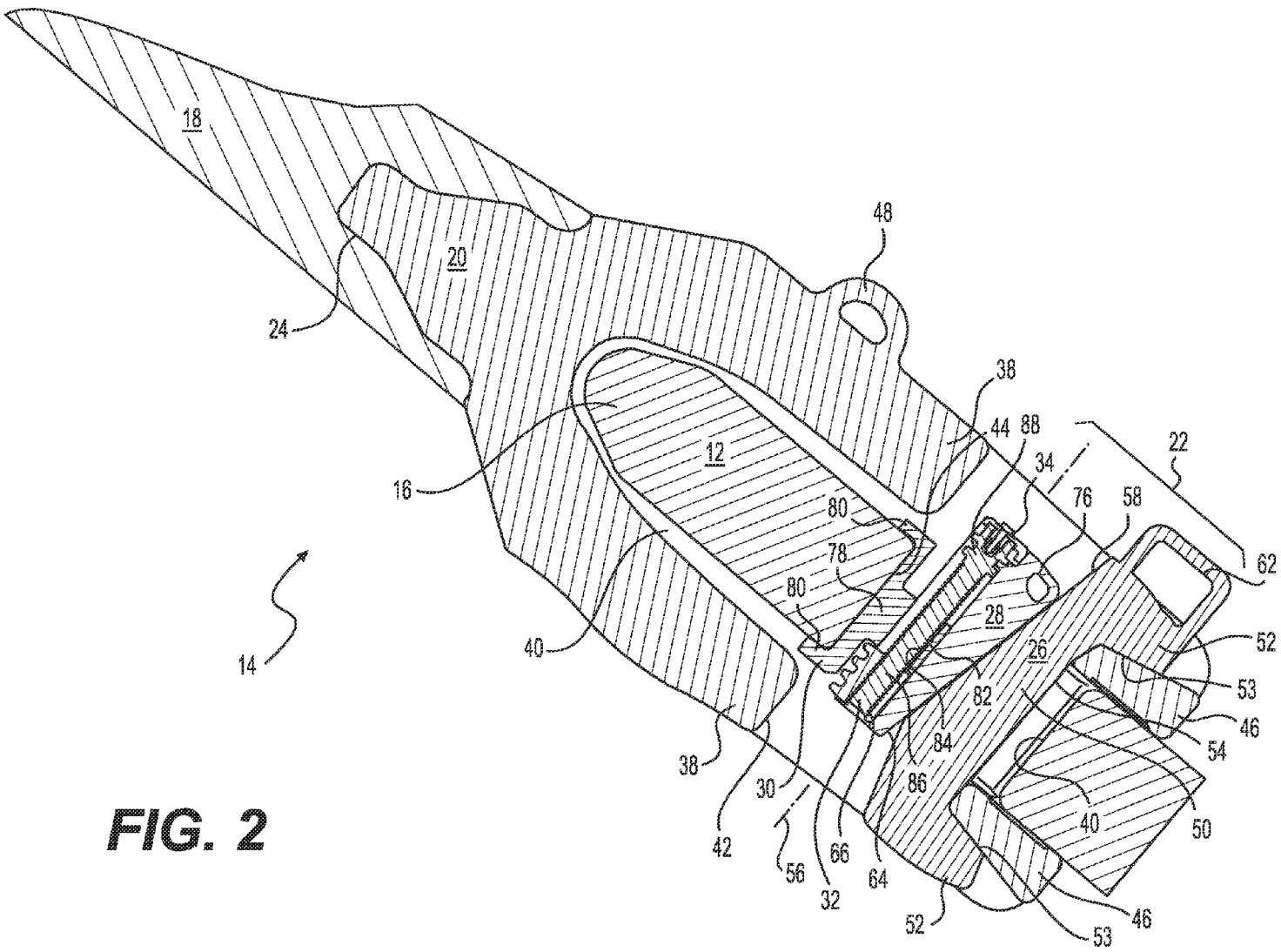
FIG. 2 is a cross-sectional side view of an exemplary tool retention system according to the concepts of the present disclosure.
Figure 3:
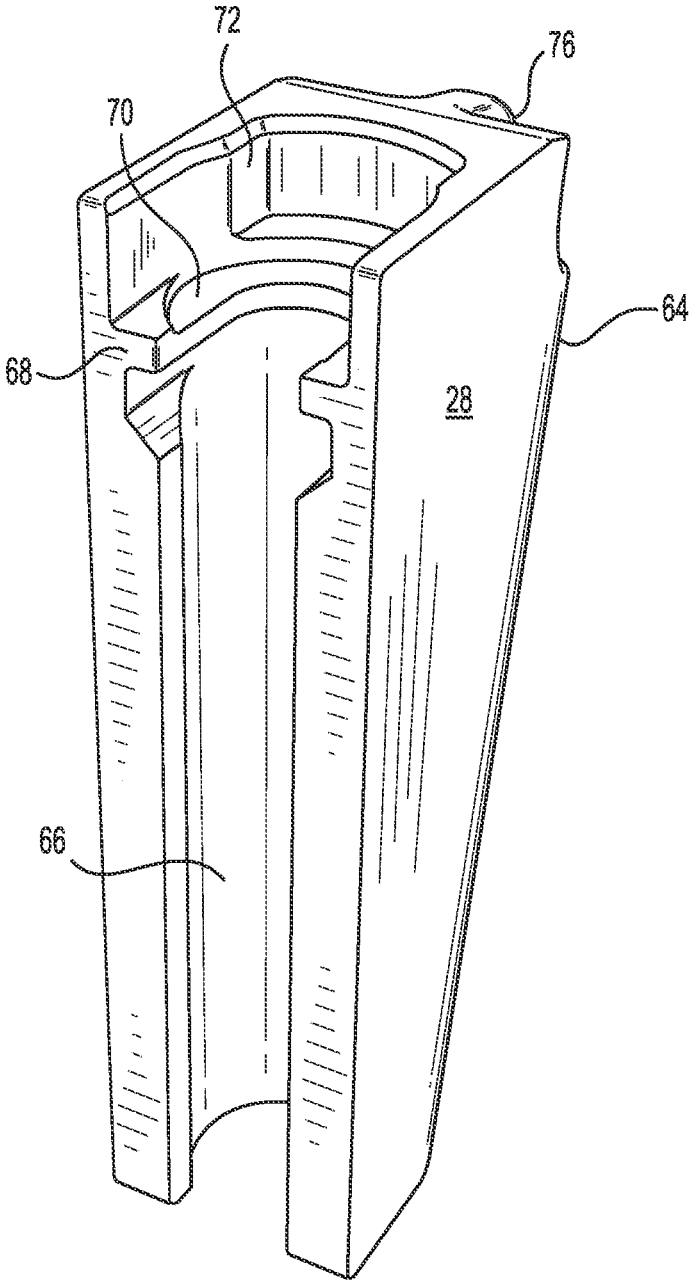
FIG. 3 is an isometric view of a wedge that forms a portion of the tool retention system of FIG. 2.
Figure 4:
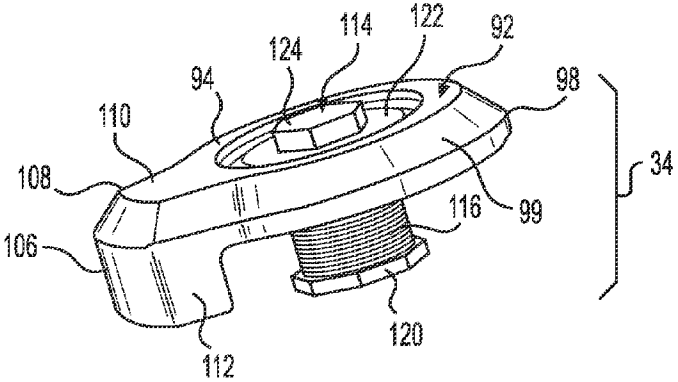
FIG. 4 is an side isometric view of a retention cap that forms a portion of the tool retention system of FIG. 2.

Wedge 28 may be located immediately adjacent outer surface 58 of clamp 26 (e.g., at a side of clamp 26 closer to cutting edge 16), and have a generally flat inclined surface 64 configured to slide against outer surface 58. With this arrangement, as wedge 28 is driven further into recess 40, clamp 26 may be forced more toward distal ends 46 of legs 38 (i.e., against the end surfaces of apertures 42, 44 and the tapered outer surfaces of legs 38). As shown in FIGS. 2-4, wedge 28 may include a longitudinal recess 66 located at a side opposite clamp 26 that is configured to receive fastener 32, and an annular protrusion 68 at a base end that extends radially inward into recess 66. In the disclosed embodiment, recess 66 may be generally circular in cross-section, and have an open side oriented away from inclined surface 64 of clamp 26. It is contemplated, however, that recess 66 may have another shape, if desired, such as a square or rectangular cross-section. As shown in FIGS. 3 and 4, a cylindrical depression 70 may be formed at the base end of wedge 28 (i.e., at an outer end of recess 66), and an elongated notch 72 may extend radially outward from depression 70 toward inclined surface 64.

Like clamp 26, wedge 28 may also be provided with a removal feature 76 that is configured to aid in the installation and/or removal of wedge 28. In the embodiment shown in FIGS. 2-4, removal feature 76 is a cylindrical eye formed at the base end of wedge 28 and extending across a width direction of thereof. With this configuration, a pin, hook, or other fastener may be inserted into a recess of removal feature 76, and a lifting or driving force applied to the eye therewith to remove or insert wedge 28 relative to apertures 42, 44.

As shown in FIG. 2, slider 30, like clamp 26, may be a generally C-shaped member, having a middle section 78, and spaced apart arms 80 located at opposing ends of middle section 78, the arms 80 extending in a common direction generally perpendicular to the orientation of middle section 78. An open side of slider 30 (relative to the C-shape) may be oriented toward cutting edge 16 (see FIG. 2) and away from clamp 26. In this configuration, arms 80 may be configured to directly engage opposing surfaces of work implement 12 at a leading end of aperture 44. A generally cylindrical protrusion 82 having a threaded bore 84 may be carried by a closed side of middle section 78 and configured to extend into recess 66 of wedge 28. Protrusion 82 may be generally aligned with recesses 66 and with a lengthwise orientation of middle section 78.

Fastener 32 may be configured to adjustably join slider 30 with wedge 28. In particular, fastener 32 may include a threaded cylindrical rod 86 and a head 88 connected to an end of rod 86. In a particular embodiment, such as that shown in FIGS. 1-8, head 88 may include a plurality of circumferentially spaced ribs extending radially outward therefrom. Rod 86 may be received within threaded bore 84 of slider 30, oriented in general alignment with axis 56, and configured to move linearly relative to rod 86 as head 88 is rotated. To facilitate rotation of fastener 32, head 88 may include a tool interface 87. In an exemplary embodiment, tool interface 87 may be in the form of a generally square recess in head 88, and may include a bore 91 extending deeper into head 88 and positioned at substantially the center of an inner surface of tool interface 87. As will be discussed in more detail below, in addition to providing an interface for a tool to rotate fastener 32, the tool interface 87 and bore 91 also allow for positioning of the retention cap 34.

As shown in FIG. 4, head 88 may include an annular groove 90 configured to receive annular protrusion 68 of wedge 28, thereby locking linear movements of fastener 32 and wedge 28. With this arrangement, as fastener 32 is rotated within and travels linearly relative to slider 30 (slider 30 being comparatively stationary and connected to work implement 12), wedge 28 may be forced into or out of apertures 42, 44, depending on the direction of rotation. And as described above, the linear motion of wedge 28 may correspond with the clamping forces generated by clamp 26 on adapter 20 and work implement 12.

Figure 5:
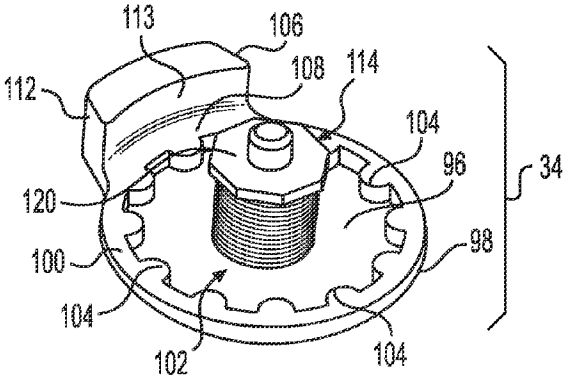
FIG. 5 is a bottom isometric view of a retention cap that forms a portion of the tool retention system of FIG. 2.
Figure 6:
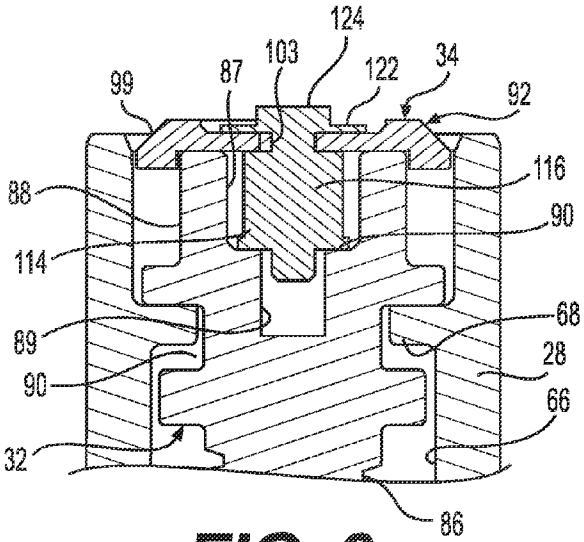
FIG. 6 is a fragmentary section view of a portion of the tool retention system of FIG. 2, including the retention cap of FIGS. 4 and 5.
Figure 8:
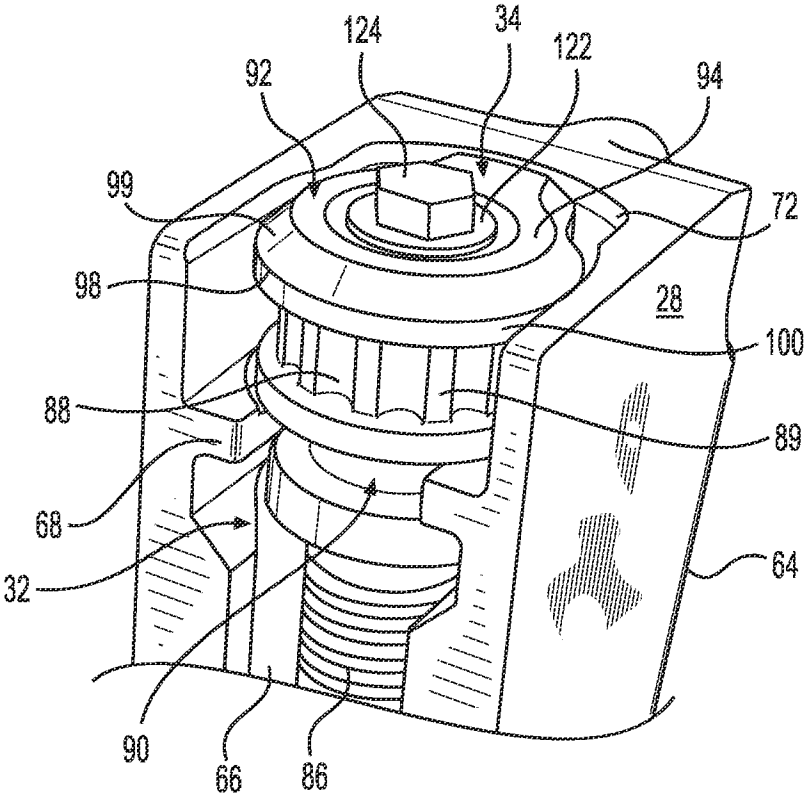
FIG. 8 is a fragmentary isometric view of a portion of the tool retention system of FIG. 2, including the retention cap of FIGS. 4 and 5.
Figure 7:
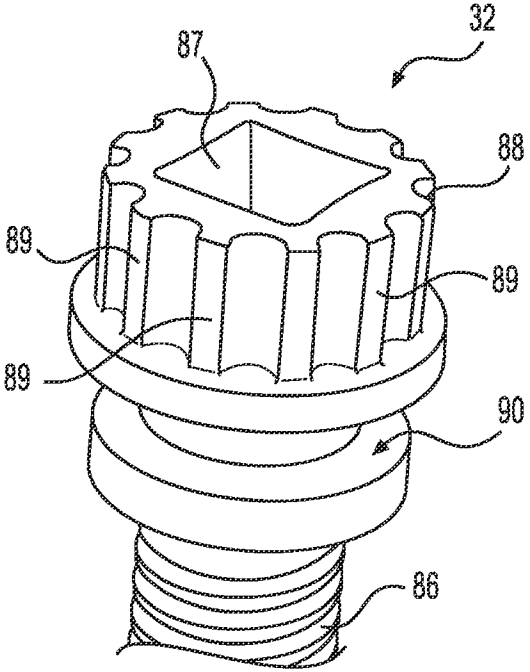
FIG. 7 is a fragmentary isometric view of a fastener that forms a portion of the tool retention system of FIG. 2.

Retention cap 34 may have geometry designed to inhibit unintentional rotation of fastener 32, once retention system 22 is fully assembled. Specifically, as shown in FIGS. 4-6, retention cap 34 may include a generally circular body 92 having a top surface 94, a bottom surface 96 and an outer peripheral edge 98. A chamfered edge 99 may be provided around the retention cap 34 adjacent to the outer peripheral surface to improve material flow over the cap 34, while also interacting with the material to create a downward force keeping cap 34 in place.

A lip 100 may extend downwardly from the bottom surface 96 of body 92 adjacent the peripheral edge 98, the lip 100 and bottom surface 96 together defining a depression 102 in cap 34. The depression 102 may be sized and shaped to receive head 88 of fastener 32 therein. A hole 103 (FIG. 6) may be provided through the circular body 92, extending from the top surface 94 through the bottom surface 96. It is also contemplated that a plurality of friction members 104 may be spaced circumferentially around the interior of lip 100, each friction member 104 extending radially inward toward the hole 103. The friction members 104 may facilitate a tight fit between retention cap 34 and head 88 of fastener 32 by engaging and resisting rotation of head 88 relative to the retention cap 34. For example, the friction members 104 may engage ribs 89 or other surfaces of the head 88. In the disclosed embodiment, friction members 104 are configured to fit between and engage the ribs 89 of heads 88.

Retention cap 34 may further include a protrusion 106 extending radially outward from the peripheral edge 98. Protrusion 106 may be generally L-shaped and include a first leg 108 having a top surface 110 extending generally parallel with the top surface 94 of circular body 92, and a second leg 112 extending generally perpendicular to the first leg 108 in the same direction that lip 100 extends from bottom surface 96. In a particular embodiment, the inner surface 113 of the second leg 108 may be arcuate or radiused to accommodate a generally cylindrical outer periphery of the head 88 of fastener 32.

Retention cap 34 may further include a retention plug 114 secured beneath the circular body 92. The retention plug may include a rubber insert 116 with a bore therethrough, a nut 120 positioned at a bottom of the insert 116, an washer 122 positioned at a top of the insert 116, and a threaded fastener 124 passing through the bore in the rubber insert, the washer 122 and the nut 120. The rubber insert 116 may be made of an expandable rubber, and may have any shape that fits within the tool interface 87 including, but not limited to, the generally cylindrical shape shown in the accompanying drawings. The nut 120 may have a radius or width, depending upon shape, that is approximately equal to or greater than the same dimension of the rubber insert 116.

The washer 122 of retention plug 114 may rest on the top surface 94 of circular body 92, with the threaded fastener passing through the hole 103. The nut 120 may include internal threads that mate with the threaded portion of threaded fastener 124 so that rotation of the nut 120 causes axial movement of the nut along the axis of the threaded fastener 124. The nut 120 may be sized and shaped to prevent rotation thereof relative to the tool interface 87 (e.g. square or hexagonal in shape). In a particular embodiment, the nut 120 may have an outer peripheral profile with at least one flat surface that engages the tool interface 87 to prevent rotation of the nut 120 relative to the fastener 32. In certain embodiments, a bottom portion of the threaded fastener 124 may extend into bore 91 in head 88. It is also contemplated that a lock nut (not shown) may be provided over the threaded portion of threaded fastener 124 below nut 120.

Once retention cap 34 is positioned over head 88, the protrusion 106 may engage interior walls of notch 72, and the friction members 104 may engage the head 88, thereby inhibiting significant rotation of retention cap 34 relative to wedge 28. Tightening of the threaded fastener 124 causes the upper and lower washers to move toward one another as the threaded fastener 124 rotates within the lower nut 120. As the lower nut 120 moves axially toward the washer 122, the expansion plug is compressed and expands radially, creating a friction force with the tool interface 87. This friction force helps to prevent rotation of fastener 32 relative to retention cap 34 and wedge 28, and further helps to prevent retention cap 34 from being lifted from head 88 by material passing over the retention system 22.

INDUSTRIAL APPLICABILITY

The disclosed tool retention system may be applicable to various earth-working machines, such as wheel loaders, electric cable shovels, excavators, front shovels, dragline machines, and bulldozers. When used to removably connect ground engaging tools to the work implements of these machines, the work implements may be protected against wear in areas experiencing damaging abrasions and impacts. Accordingly, the disclosed tool retention system may help to prolong the useful life of the implements and the machines. Use of tool retention system 22 to connect GET 14 to work implement 12 will now be described in detail.

To connect a particular GET 14 to cutting edge 16 of a particular work implement 12, a service technician may first position legs 38 of adapter 20 over cutting edge 16 so that apertures 42 of adapter 20 are generally aligned with aperture 44 of work implement 12. Clamp 26 may then be inserted through apertures 42 and 44, with the open side of clamp 26 facing away from cutting edge 16. Inner surfaces 53 of arms 52 may engage the tapered surfaces at apertures 42 and sandwich legs 38 therebetween.

Once adapter 20 of GET 14 is in place relative to work implement 12, the service technician may install retention system 22 to retain GET 14 in place during operation of machine 10. To install retention system 22, the service technician may insert retention system 22 as a sub-assembly and at an angle into recess 40. That is, the service technician may insert slider 30 into recess 40 with the upper-most arm 80 tilted closer to cutting edge 16 than the lower-most arm 80. After setting the upper-most arm 80 onto the upper surface of work implement 12 at the leading end of aperture 44, the lower-most arm 80 may be rotated in a clock-wise direction (relative to the perspective of FIG. 2) until the lower-most arm 80 is located outside of work implement 12 and middle section 78 engages the leading end of aperture 44. At this point in time, inclined surface 64 of wedge 28 should be resting against outer surface 58 of clamp 26.

Once retention system 22 is positioned within apertures 42, 44, the service technician may rotate fastener 32 to tighten the connection between work implement 12 and GET 14. Specifically, as the service technician drives fastener 32 into slider 30 (e.g., by a clockwise rotation of head 88), groove 90 may engage protrusion 68 and advance wedge 28 further into recess 40. Because of the taper of wedge 28, advancement of wedge 28 into recess 40 may force clamp 26 and slider 30 away from each other. And as clamp 26 moves toward distal ends 46 of legs 38, the taper of legs 38 interacting with arms 52 of clamp 26 may result in a greater clamping force being exerted on legs 38. This force may function to sandwich work implement 12 between legs 38 of adapter 20, thereby holding GET 14 in place during operation of machine 10. Once the appropriate clamping force has been generated between work implement 12 and GET 14 by tightening of fastener 32, retention cap 34 should be pressed over head 88 with projection 106 extending into notch 72 to inhibit unintentional reverse rotation of fastener 32 that could loosen the engagement of retention system 22. The threaded fastener 124 may then be tightened to expand the retention plug 114 within the tool interface 87, thereby further securing the retention cap 34 to head 88.

Over time, components of work implement 12, GET 14, and retention system 22 may wear. If unaccounted for, this wear could result in failure of the connection between work implement 12 and GET 14. Accordingly, after a period of use, retention system 22 should be tightened to remove slack created by the wear. This tightening can be accomplished in two ways. First, retention cap 34 may be removed and fastener 32 driven further into recess 40, thereby causing wedges 28 to force clamp 26 and slider 30 further apart. This way of tightening the connection between work implement 12 and GET 14, however, may only be available when the associated wear is relatively low.

Once the component wear of work implement 12, GET 14, and/or retention system 22 exceeds a threshold amount, one or more portions of retention system 22 should be replaced. For example, slider 30 may be replaced to accommodate the large amount of wear that has occurred. In one example, slider 30 may be produced with a range of sizes. In this example, after the wear of work implement 12, GET 14, and/or retention system 22 has exceeded the threshold amount, the original slider 30 may be replaced with a new slider 30 having a reduced height between arms 80 and/or a middle section 78 with an increased thickness.

The disclosed retention system may be relatively simple and low-cost. Specifically, because clamp 26 and wedge 28 may engage each other at a smooth sliding surface, these components may be easy to manufacture, resulting in inexpensive parts. In addition, because excessive wear can be accommodated with replacement of relatively inexpensive components (e.g., with replacement of slider 30 as opposed to clamp 26), service costs of machine 10 may be kept low. Further, the retention plug 114 of retention cap 34 helps to ensure that fastener 32 does not loosen during use.

It will be apparent to those skilled in the art that various modifications and variations can be made to the disclosed retention system. Other embodiments will be apparent to those skilled in the art from consideration of the specification and practice of the disclosed retention system. It is intended that the specification and examples be considered as exemplary only, with a true scope being indicated by the following claims and their equivalents.

What is claimed is:

1. A retention cap for use with a fastener having a head with a tool interface, the retention cap comprising:

a body having a top surface and a bottom surface;

a protrusion extending outward from the body; and a retention plug extending from the bottom surface of the body, the retention plug including a threaded fastener, a rubber insert received around the threaded fastener, and a nut positioned on the threaded fastener, wherein the retention plug is configured to cause expansion of the rubber insert within the tool interface upon rotation of one of the nut or threaded fastener, and wherein the nut includes an outer peripheral profile with at least one flat surface and is configured to be prevented from rotating within the tool interface of the head.

2. The retention cap of claim 1, wherein the body has a generally circular shape.

3. The retention cap of claim 1, wherein the protrusion is generally L-shaped and includes a first leg extending generally parallel to the top surface of the body, and a second leg extending generally perpendicularly away from the top surface and past the bottom surface.

4. The retention cap of claim 1, further comprising:

a chamfered surface adjacent to a peripheral surface of the body, the chamfered surface configured to direct material flow over the retention cap.

5. The retention cap of claim 1, further comprising:

a lip extending downwardly from the bottom surface adjacent a peripheral surface of the body, the lip and the bottom surface of the body defining a depression configured to receive the head of the fastener therein.

6. The retention cap of claim 5, further comprising:

a plurality of friction members extending inwardly from the lip and configured to engage the head of the fastener.

7. The retention cap of claim 1, wherein the retention plug further includes a washer positioned adjacent to the top surface of the body.

8. The retention cap of claim 7, wherein the threaded fastener includes a second head that is positioned adjacent to the washer.

9. A retention cap for a fastener comprising:

a generally circular body having a top surface, a bottom surface and an outer peripheral surface;

a bore defined by the body and extending between the top surface and the bottom surface;

a protrusion extending radially outward from the body; and a retention plug extending from the bottom surface, the retention plug including a threaded fastener with a head positioned adjacent the top surface of the body, a rubber insert received around the threaded fastener and positioned adjacent the bottom surface of the body, and a nut positioned on the threaded fastener, wherein rotation of the nut or threaded fastener is configured to compress and cause lateral expansion of the rubber insert within a tool interface of a fastener, and wherein the nut includes an outer peripheral profile with at least one flat surface and is configured to be prevented from rotational movement within the tool interface.

10. The retention cap of claim 9, wherein the protrusion includes a first leg extending generally parallel to the top surface of the body, and a second leg extending generally perpendicularly away from the top surface and past the bottom surface.

11. The retention cap of claim 9, further comprising:

a chamfered surface adjacent the outer peripheral surface, the chamfered surface configured to direct material flow over the retention cap.

12. The retention cap of claim 9, further comprising:

a lip extending downwardly from the bottom surface of the body adjacent the outer peripheral surface, the lip and the bottom surface defining a depression configured to receive a second head of a second fastener therein.

13. The retention cap of claim 12, further comprising:

a plurality of friction members extending inwardly from the lip and configured to engage the head of the fastener.

14. The retention cap of claim 9, wherein the retention plug further includes a washer positioned adjacent to the top surface of the body.

15. A tool retention system comprising:

a generally C-shaped clamp configured to be disposed within an aperture of a work implement and to engage apertures in a tool adapter;

a wedge configured to be disposed within the apertures of the tool adapter and the work implement and against the generally C-shaped clamp;

a generally C-shaped slider configured to be disposed within the apertures of the tool adapter and to engage the aperture of the work implement, and having an opening oriented away from the generally C-shaped clamp;

a fastener configured to connect the generally C-shaped slider to the wedge, the fastener having a head with a tool interface;

a nut positioned on the fastener, including an outer peripheral profile with at least one flat surface, and being configured to be prevented from rotating within the tool interface of the head; and a retention cap positioned over the head of the fastener, the retention cap including an expandable rubber insert that is positioned within the tool interface of the head.

16. The tool retention system of claim 15, wherein the retention cap further comprises a projection configured to be received in a notch in the wedge to prevent rotation of the retention cap relative to the wedge.

17. The tool retention system of claim 15, wherein the retention cap includes a depression configured to receive the head of the fastener, and a plurality of friction members on the retention cap for engagement with the head.

18. The tool retention system of claim 15, wherein the retention cap further includes a threaded fastener and nut arrangement configured to compress the rubber insert, causing the rubber insert to expand and engage the tool interface.

* * * * *